US009193559B2

(12) United States Patent
Rumy et al.

(10) Patent No.: US 9,193,559 B2
(45) Date of Patent: Nov. 24, 2015

(54) SPLICED CARBON FIBER TOW AND SPLICING METHOD

(75) Inventors: Zsolt Rumy, St. Louis, MO (US); Gabor Kovacs, Budapest (HU)

(73) Assignee: Zoltek Companies, Inc., St. Louis, MO (US)

( * ) Notice: Subject to any disclaimer, the term of this patent is extended or adjusted under 35 U.S.C. 154(b) by 327 days.

(21) Appl. No.: 13/580,681

(22) PCT Filed: Feb. 24, 2011

(86) PCT No.: PCT/US2011/026069

§ 371 (c)(1),
(2), (4) Date: Aug. 23, 2012

(87) PCT Pub. No.: WO2011/106523

PCT Pub. Date: Sep. 1, 2011

(65) Prior Publication Data

US 2012/0321888 A1 Dec. 20, 2012

Related U.S. Application Data

(60) Provisional application No. 61/308,516, filed on Feb. 26, 2010.

(51) Int. Cl.
*B65H 69/06* (2006.01)

(52) U.S. Cl.
CPC ..... *B65H 69/065* (2013.01); *B65H 2701/314* (2013.01); *B65H 2701/37* (2013.01); *Y10T 428/2918* (2015.01)

(58) Field of Classification Search
CPC ..... B65H 69/065
USPC ..... 57/22, 202
See application file for complete search history.

(56) References Cited

U.S. PATENT DOCUMENTS

| | | | | |
|---|---|---|---|---|
| 4,534,160 | A * | 8/1985 | Lorenz | 57/22 |
| 4,803,762 | A | 2/1989 | Sheehan | |
| 4,964,267 | A * | 10/1990 | Oehy et al. | 57/22 |
| 6,412,262 | B2 * | 7/2002 | Ragnoli et al. | 57/22 |
| 6,485,592 | B1 * | 11/2002 | Yoshimura et al. | 156/148 |
| 6,722,116 | B1 * | 4/2004 | Takeuchi et al. | 57/22 |
| 2001/0013160 | A1 * | 8/2001 | Ragnoli et al. | 28/271 |
| 2004/0020182 | A1 * | 2/2004 | Premi | 57/22 |
| 2004/0168425 | A1 * | 9/2004 | Kawamura et al. | 57/22 |

(Continued)

FOREIGN PATENT DOCUMENTS

EP 0 909 842 A1 4/1999

OTHER PUBLICATIONS

International Search Report for corresponding International Application No. PCT/US2011/026069 mailed Jun. 8, 2011.

(Continued)

*Primary Examiner* — Shaun R Hurley
(74) *Attorney, Agent, or Firm* — Renner, Otto, Boisselle & Sklar, LLP

(57) ABSTRACT

A spliced fiber tow (40) having a uniform density along its entire length is provided. The spliced fiber tow is manufactured by rarefying the ends (22, 32) of the two fiber tow segments to be joined, aligning the rarefied regions (26, 36) and then applying pressurized gas to entangle the filaments in the rarefied regions. An apparatus (50) for forming the spliced fiber tow includes a pair of rarefying blades (86, 92) and an entanglement element (58).

3 Claims, 14 Drawing Sheets

(56) References Cited

U.S. PATENT DOCUMENTS

| | | | | |
|---|---|---|---|---|
| 2008/0202693 | A1 | 8/2008 | Torres Martinez | |
| 2009/0139197 | A1 * | 6/2009 | Sikula et al. | 57/22 |

OTHER PUBLICATIONS

Written Opinion of the International Searching Authority for corresponding International Application No. PCT/US2011/026069 mailed Jun. 8, 2011.

* cited by examiner

SPLICED CARBON FIBER TOW AND SPLICING METHOD

This application is a national phase of International Application No. PCT/US2011/026069 filed Feb. 24, 2011 and published in the English language, which claims priority to Application No. U.S. 61/308,516 filed Feb. 26, 2010.

TECHNICAL FIELD

The present invention relates to splicing of fiber tows and more specifically, to spliced lengths of carbon fiber tow and to a method and apparatus for manufacturing the same.

BACKGROUND

Carbon fibers are long, thin filaments of material about 0.005 to 0.010 mm in diameter and composed mostly of carbon atoms. Carbon fibers are typically produced as tows or yarns consisting of several thousands of carbon fibers. The carbon fiber tow may be used by itself or woven into a fabric. The tow or fabric is combined with epoxy or other polymer and wound or molded into shape to form various composite materials. Carbon fiber reinforced composite materials are used in many applications where light weight and high strength are needed.

In order to provide continuous lengths of carbon fiber tow, it is necessary to splice the ends. Conventional methods of splicing fiber ends include applying a coating composition onto the fiber ends, placing the coated ends in contact and drying or curing the coating to form a bonded splice. However, during subsequent manufacturing operations, the bonded area may not be compatible with the resin used to impregnate the fibers, which could also cause a local potential failure or premature failure.

Joining the ends of fibers from lengths of tow or yarn by air entanglement methods is known. In this method, the ends of the tow or yarn are overlapped with each other and an air stream is applied to the overlapped portions to cause the fibers therein to become entangled with each other. However, the fiber density at the joined portion becomes much greater than the fiber density in the main portions of the tow. In other words, the fiber density is double in the splice area. This increased bulk can damage part of the tow and may cause problems in subsequent operations. For example, in pultrusion processes, the increased bulk may have difficulty passing through the die and/or cause the resin impregnated therein not to fully penetrate the tow or not to cure completely.

SUMMARY

In accordance with a first aspect of the present invention, there is provided a spliced fiber tow that includes (a) a first fiber tow having a terminal end, a starting end, and a rarefied portion, the rarefied portion extending from the terminal end to a first joint end; (b) a second fiber tow having, a terminal end, a starting end, and a rarefied portion, the rarefied portion extending from the starting end to a second joint end; and (c) a splice joint comprising joined rarified portions of the first fiber tow and the second fiber tow; wherein the density of the spliced fiber tow is substantially uniform from the starting end of the first fiber tow to the terminal end of the second fiber tow.

In one embodiment, the first and second fiber tows are each made up of 3,000 or more carbon filament fibers. The first and second fiber tows may each be made up of about 50,000 or more carbon filament fibers.

In one embodiment, the splice joint comprises entangled fibers of the rarefied portions of the first and second fiber tows.

The dry splice joint, in one embodiment, is able to withstand a tension force of at least 40 kg, or at least 60 kg. The splice joint of the carbon fiber tows, in one embodiment, when impregnated with uncured epoxy resin, is able to withstand a tension force of at least 28 kg, or at least 50 kg.

In accordance with a second aspect of the present invention, there is provided a method for forming a spliced fiber tow, which includes the steps of (a) providing a first fiber tow having a terminal end and a starting end, and a second fiber tow having a terminal end and a starting end, the first and second fiber tows each made up of a plurality of fiber filaments; (b) cutting and removing a portion of the fiber filaments of the first fiber tow to form a rarefied region that extends from the terminal end of the first fiber tow to a first joint end; (c) cutting and removing a portion of the fiber filaments of the second fiber tow to form a rarefied region that extends from the starting end of the second fiber tow to a second end joint; (d) aligning the rarefied region of the first fiber tow with the rarefied region of the second fiber tow so that the starting end of the second fiber tow substantially meets the joint end of the first fiber tow, and the terminal end of the first fiber tow substantially meets joint end of the second fiber tow; and (e) subjecting the aligned rarefied regions of the first fiber tow and the second fiber tow to gas turbulences to effect entanglement of the fiber filaments of the first and second fiber tows with each other so as to form a splice. The density of the spliced fiber tow produced is substantially uniform from the starting end of the first fiber tow to the terminal end of the second fiber tow.

In one embodiment, the first and second fiber tows each contain 3,000 or more carbon fiber filaments. The first and second fiber tows may each contain 50,000 or more carbon fiber filaments.

In the method of forming a spliced fiber tow, cutting the first carbon fiber tow and cutting the second fiber tow may be carried out simultaneously.

In accordance with a third aspect of the invention, there is provided an apparatus for forming a spliced fiber tow. The fiber splicing apparatus includes: a pair of rarefying blades spaced apart from each other for rarefying end portions of flat fiber tows; a pair of support bases spaced apart from each other for supporting the end portions of the flat fiber tows, each support base having a top surface opposed to one of the pair of the rarefying blades, the top surface having an insection aligned with the rarefying blade; and an entanglement element that includes a first comb-shaped blowing head, a second comb-shaped blowing head, and a passage therebetween, each blowing head having a plurality of nozzles facing the passage for directing gas at fiber tows within the passage, the entanglement element positioned between the pair of support bases.

The fiber splicing apparatus may further include at least one moveable member disposed between the entanglement element and one of the support bases for aligning the flat fibers within the passage.

In one embodiment, the fiber splicing apparatus further includes at least one terminating blade, the terminating blade spaced apart from one of the rarefying blades, the distance between the terminating blade and the rarefying blade defining the length of the rarefied end portion of the fiber tow.

DETAILED DESCRIPTION

A spliced fiber tow having a substantially uniform density along its length and a method for manufacturing the spliced fiber tow is provided in accordance with the present invention. In one embodiment, the spliced fiber tow is made by joining two lengths of carbon fiber tow, each carbon fiber tow having 3,000 or more carbon fiber filaments. In one embodiment, each carbon fiber tow has about 50,000 carbon fiber filaments. Although described herein with reference to carbon fiber tows, the material of the fiber tows is not limited to carbon fiber, but includes aramid fiber, polyethylene fiber, glass fiber, and other fibers.

Figure 1A:
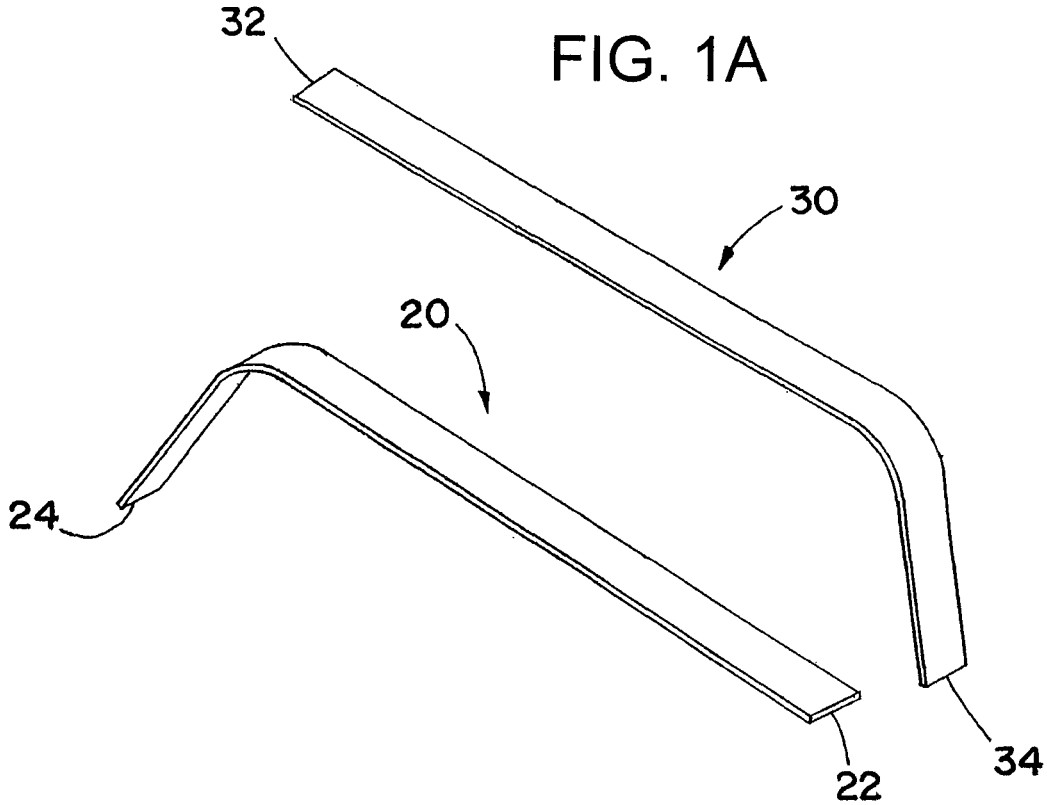
FIGS. 1A-1C are schematic views illustrating steps of a method of joining fiber tows according to an embodiment of the present invention.
Figure 1B:
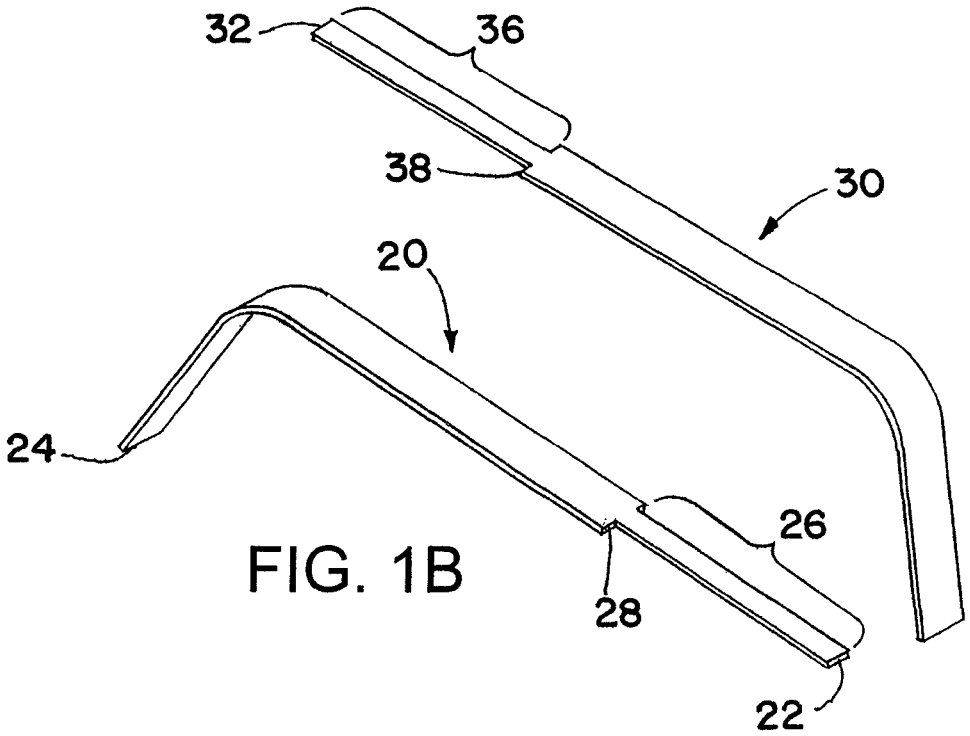

Referring to FIG. 1A, a first carbon fiber tow 20 and a second carbon fiber tow 30 are spliced to form a continuous length of carbon fiber tow. The first carbon fiber tow 20 has a starting end 22 and a terminal end 24. The second carbon fiber tow 30 has a starting end 32 and a terminal end 34. As illustrated in FIG. 1B, at the starting end 22 of the first carbon fiber tow 20, some of the filaments of the tow are removed to create a rarefied portion 26 that begins at the starting end 22 and extends to a joint end 28. Similarly, at the starting end 32 of the second carbon fiber tow 30, some of the filaments of the tow are removed to create a rarefied portion 36 that begins at the starting end 32 and extends to a joint end 38. The length of the rarefied portion 26 of the first carbon tow 20 is substantially the same as the length of the rarefied portion 36 of the second carbon fiber tow.

In one embodiment, approximately half of the filaments are removed in each of the rarefied portions 26 and 36. The step of cutting the filaments to rarefy the ends of the first and second carbon fiber tows may be performed sequentially or simultaneously. In one embodiment, the second carbon fiber tow 30 at the starting end 32 region is positioned over the first carbon fiber tow 20 in the starting end 22 region, and both carbon fiber tows are rarefied at the same time.

Figure 1C:
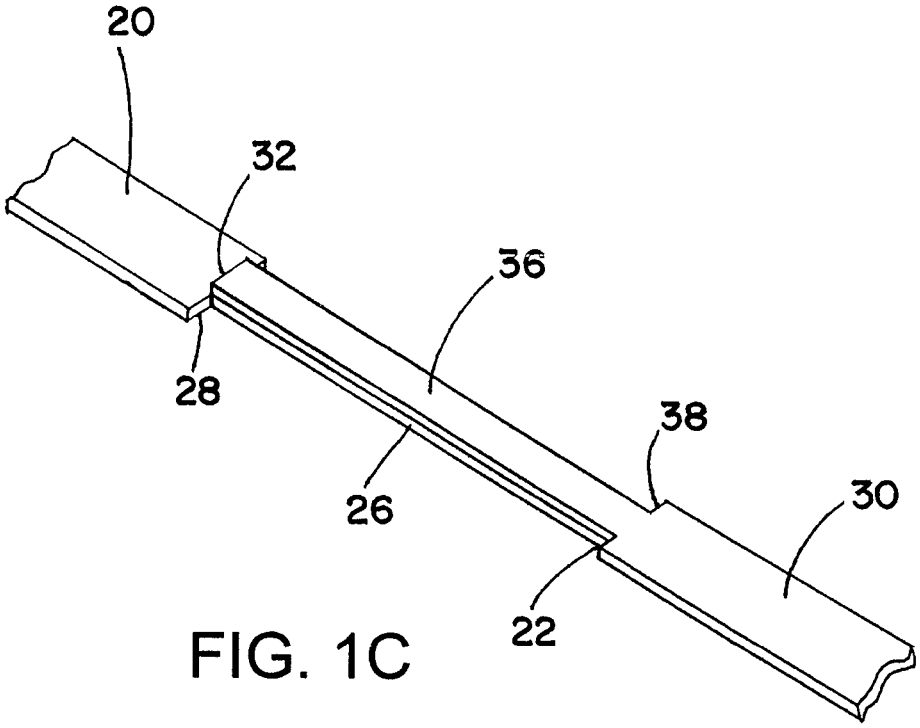

As illustrated in FIG. 1C, the rarefied region 36 of the second carbon fiber tow 30 is positioned over the rarefied region 26 of the first carbon fiber tow 20, so that the starting end 32 of the second carbon fiber tow 30 is substantially aligned with the joint end 28 of the first carbon fiber tow 20, and the starting end 22 of the first carbon fiber tow 20 is substantially aligned with the joint end 38 of the second carbon fiber tow 30. It does not matter which of the two carbon fiber tows is positioned on top, so long as the rarefied portions (26, 36) are aligned. The cut filaments are removed and a splice is formed in the overlapping rarefied regions by air entanglement.

Using an air entanglement apparatus or pneumatic splicing apparatus, high pressure gas, e.g., air, generally causes the fibers of the yarn or tows therein to loosen and mingle with each other thereby to effect a splice. A preferred embodiment of a splicing apparatus is described below.

Figure 2:
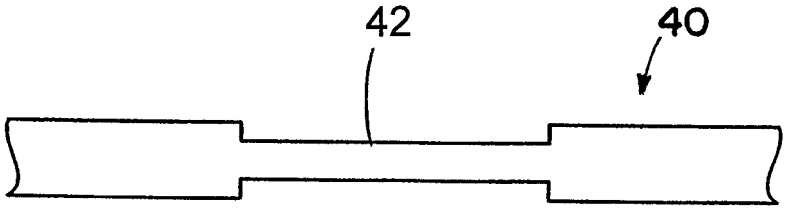
FIG. 2 is a schematic view illustrating a spliced fiber tow in accordance with the present invention.
Figure 3:
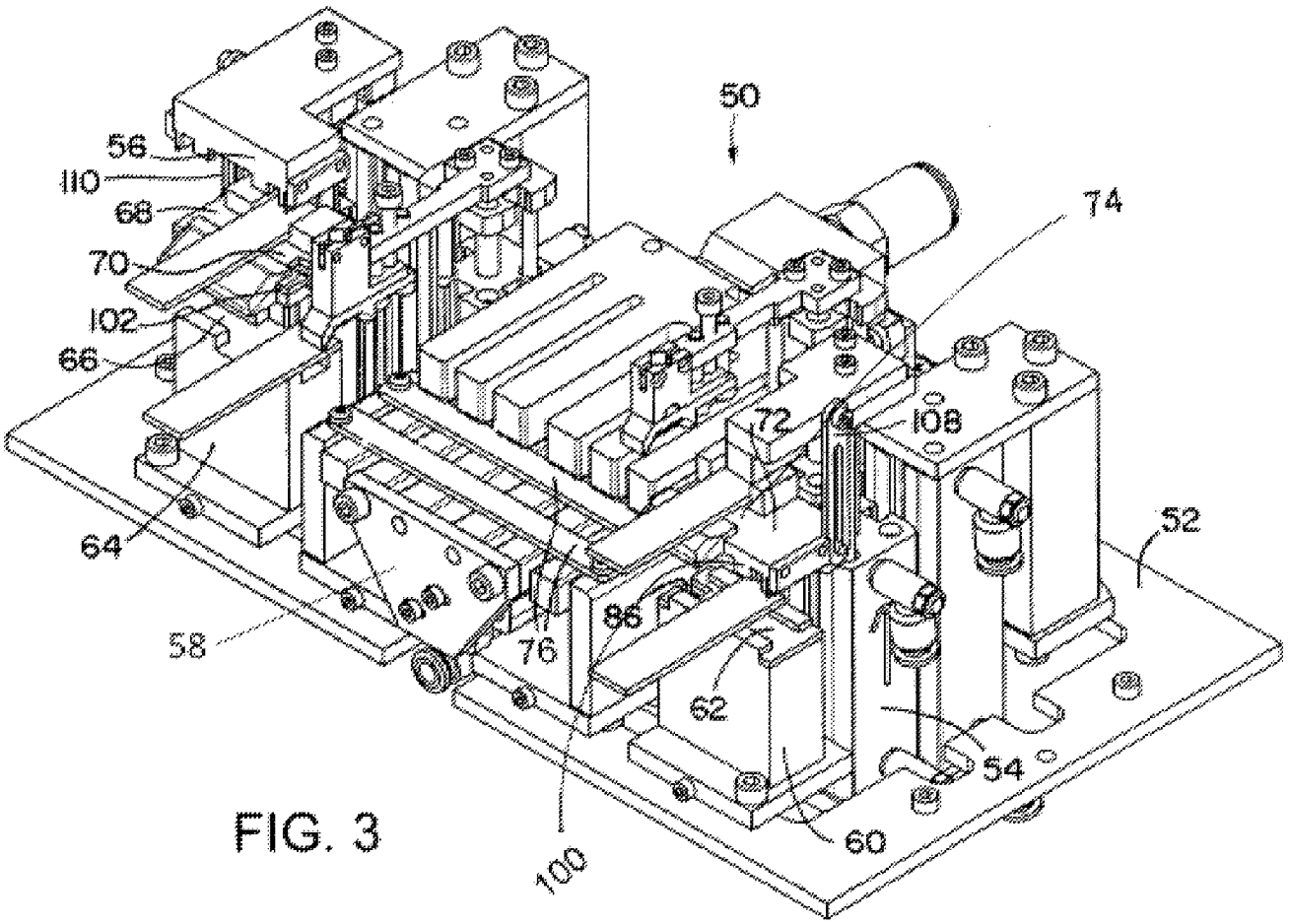
FIG. 3 is a schematic perspective view of an embodiment of the splicing assembly of the present invention.

As illustrated in FIG. 2, the filaments in the rarefied regions 26 and 36 are entangled to create a splice 42. The density of the spliced carbon fiber tow 40 along its length is substantially uniform from the terminal end 24 of the first carbon fiber tow 20 to the terminal end 34 of the second carbon fiber tow 30.

The spliced carbon fiber tow includes (a) a first carbon fiber tow having a terminal end, a starting end, and a rarefied portion, the rarefied portion extending from the starting end to a first joint end; (b) a second carbon fiber tow having, a terminal end, a starting end, and a rarefied portion, the rarefied portion extending from the starting end to a second joint end; and (c) a splice joint comprising joined rarified portions of the first carbon fiber tow and the second carbon fiber tow. The density of the spliced carbon fiber tow is substantially uniform from the starting end of the first carbon fiber tow to the terminal end of the second carbon fiber tow.

With the method described herein, not only can longer lengths of carbon fiber tow be produced, but precisely metered spools of product can be provided to customer specifications.

Referring now to FIGS. 3 to 10, an exemplary splicing apparatus 50 is shown schematically. The splicing apparatus 50 includes a baseboard 52, onto which are mounted a first rarefier assembly 54, a second rarefier assembly 56 and a tow joining assembly 58. First rarefier assembly 54 includes a first tow holder 60 having a first guide channel 62 on the upper surface that extends laterally from an inner edge to an outer edge of the first tow holder 60. The guide channel 62 facilitates placement of the first tow 20 within the first rarefier assembly 54 for rarefying the starting end 22 of the first tow. The width of guide channel 62 is generally equal to the width of the fiber tow prior to rarefying.

Second rarefier assembly 56 located on the opposite side of the tow joining assembly 58 includes a second tow holder 64, which includes a second guide channel 66 for facilitating placement of the extending length of the first fiber tow 20. Second rarefier assembly 56 also includes third tow holder 68 having a third guide channel 70 on the upper surface that extends laterally from an inner edge to an outer edge of the third tow holder 68. The guide channel 70 facilitates placement of the second tow 30 within the second rarefier assembly 56 for rarefying the starting end 32 of the second tow. The width of the guide channel 70 is generally equal to the width of the fiber tow prior to rarefying. The first rarefier assembly 54 further includes a fourth tow holder 72 having a guide channel 74 on its upper surface for facilitating placement of the extending length of the second tow 30.

Figure 4:
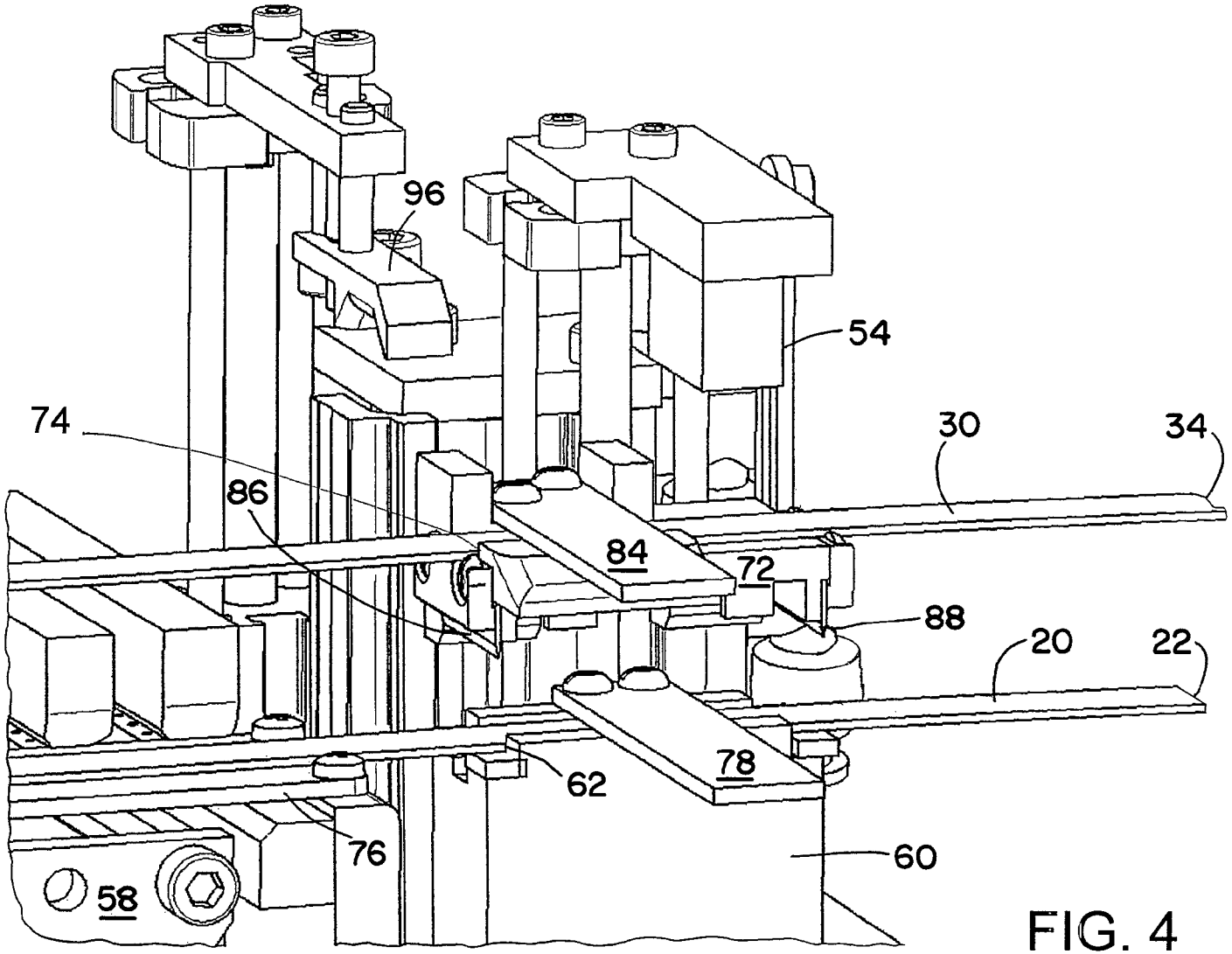
FIG. 4 is an enlarged partial view of the splicing assembly of FIG. 3 illustrating placement of the fiber tows in a first assembly portion.
Figure 5:
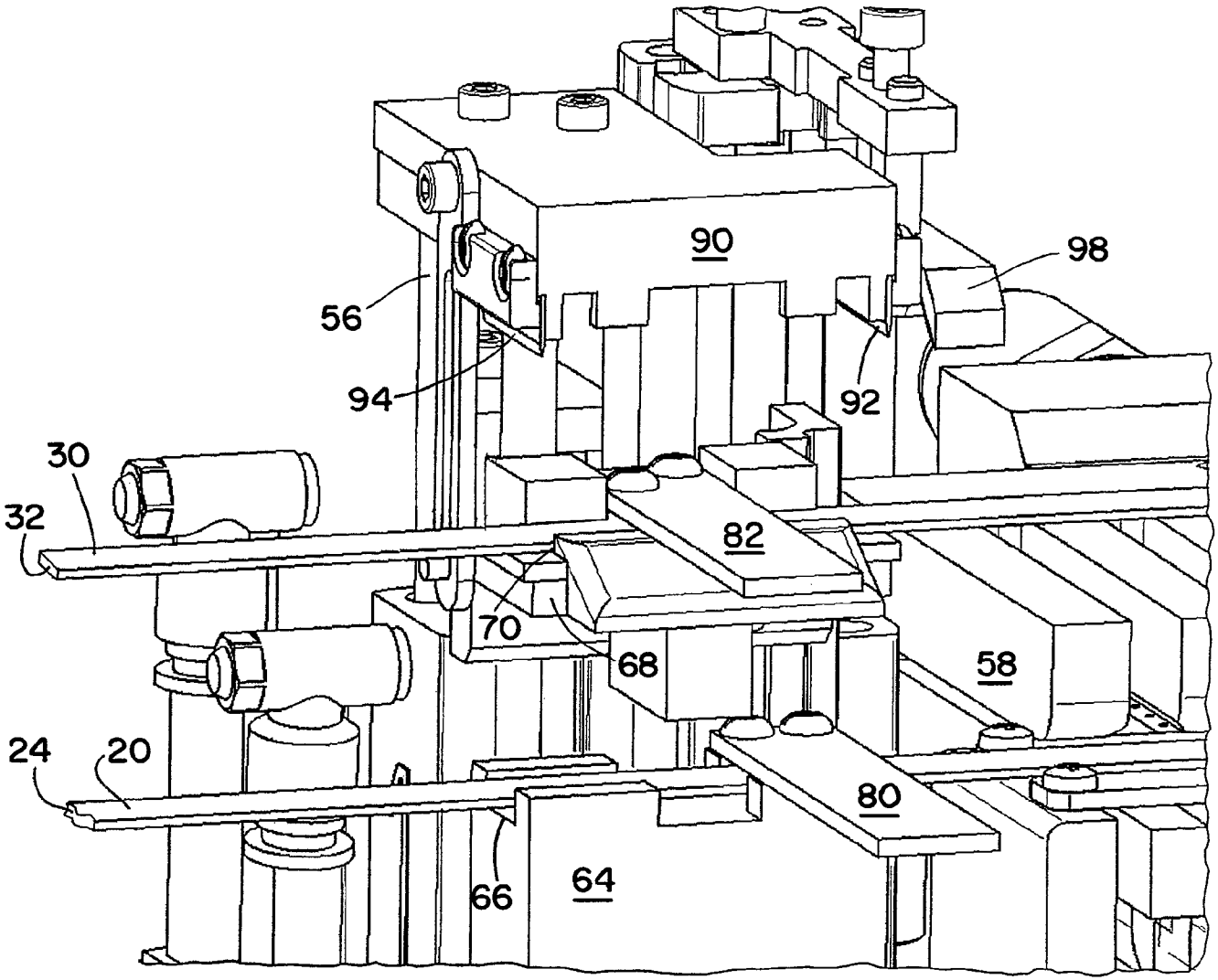
FIG. 5 is an enlarged partial view of the splicing assembly of FIG. 3 illustrating placement of the fiber tows in a second assembly portion.

Referring to FIGS. 4 and 5, placement of the first and second tows 20, 30 within the splicing apparatus 50 is illustrated. Prior to the splicing operation, first tow 20 is positioned in the splicing apparatus 50 with its starting end 22 extending beyond of the outer edge of first tow holder 60 of first rarefier assembly 54. The length of the first tow 20 extends through first guide channel 62, across the joining assembly 58 between guide plates 76 and through second guide channel 66 of the second tow holder 64 so that the terminal end 24 of the first tow extends beyond the outer edge of the second tow holder 64. Tabs 78, 80 secured to the first tow holder and second tow holder, respectively, may be included to hold the first tow within the guide channels 62, 66.

Second tow 30 is positioned in the splicing apparatus 50 above the first tow 20, with its starting end 32 extending beyond the outer edge of the third tow holder 68 of the second rarefier assembly. The length of the second tow 30 extends through third guide channel 70, across joining assembly 58 and through fourth guide channel 74 of the fourth tow holder 72 so that the terminal end 34 of the second tow extends beyond the outer edge of the fourth tow holder 72. Tabs 82, 84 secured to the third tow holder and fourth tow holder, respectively, may be included to hold the second tow within the guide channels 70, 74.

Figure 6:
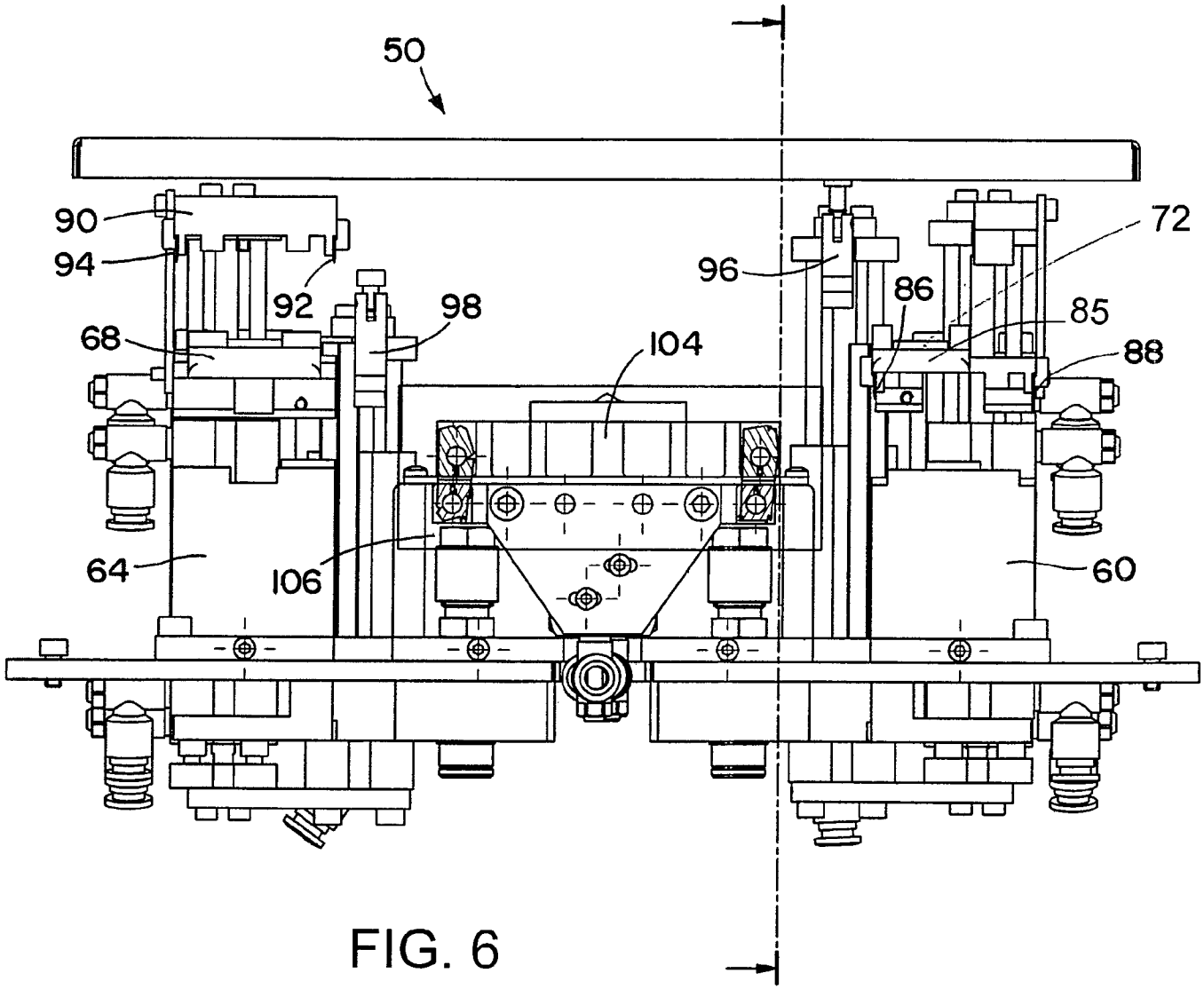
FIG. 6 is a front view of the splicing apparatus shown in FIG. 3
Figure 7:
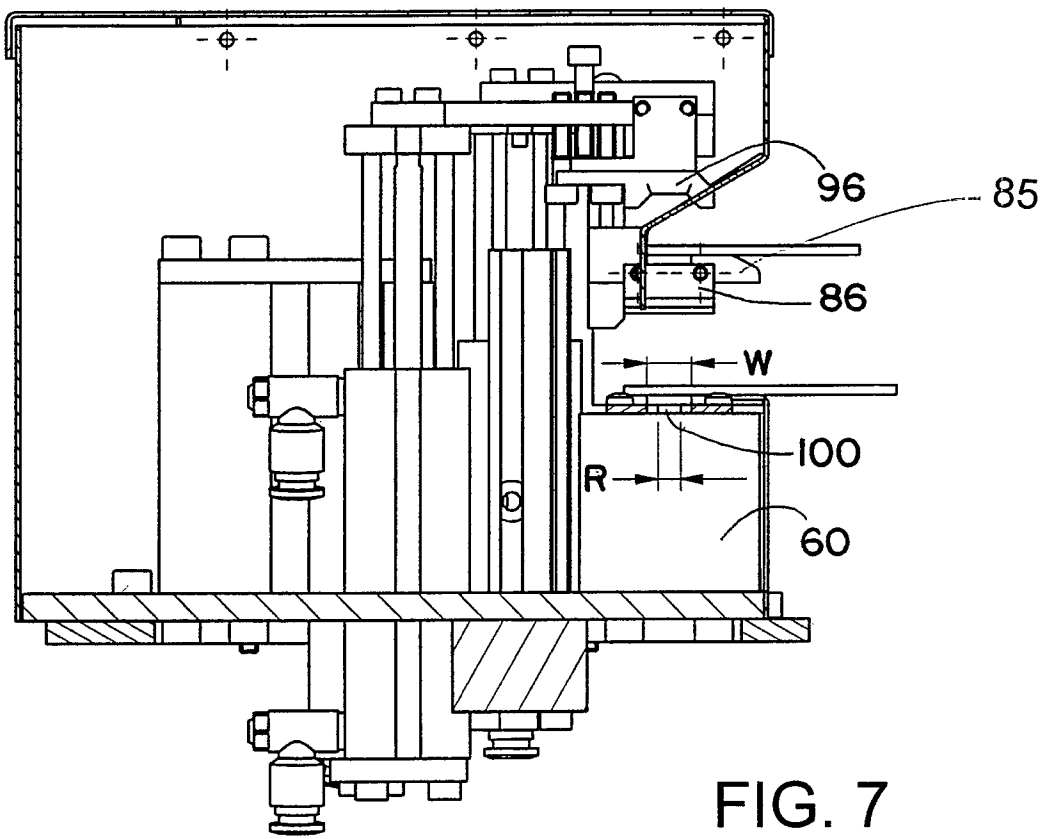
FIG. 7 is a view along the dashed line of FIG. 4.

Before entangling the fibers of the first tow 20 with the fibers of the second tow 30, a rarefied portion 26 is formed in the first tow 20 and a rarefied portion 36 is formed in the second tow 30. Referring to FIGS. 6 and 7, rarefied portion 26 having a width R is formed by removing the outer fibers on each side edge of the first tow 20 having an initial width W, the rarefied portion being proximate to the starting end 22. First blade holder 85 holds a first rarefying blade 86 and a first terminating blade 88. When the first blade holder 85 is lowered, first terminating blade 88 severs a portion of the first tow 20 to form a "clean" starting end 22. First rarefying blade 86 severs only the fibers at the side edges of first tow 20, as the first tow holder has a first insection 100 below blade 86 at the inner edge of guide channel 62 of the first tow holder so that first rarefying blade 86 cannot sever the center fibers at joint end 28.

Similarly, rarefied portion 36 having a width R is formed by removing the outer fibers on each side edge of the second tow 30 having an initial width W, the rarefied portion being proximate to the starting end 32. Second blade holder 90 holds a second rarefying blade 92 and a second terminating blade 94. When the second blade holder 90 is lowered, second terminating blade 94 severs a portion of the second tow 30 to form a "clean" starting end 32. Second rarefying blade 92 severs only the fibers at the side edges of second tow 30, as the third tow holder 68 has a second insection 102 below blade 92 at the inner edge of guide channel 70 of the third tow holder 68 so that second rarefying blade 92 cannot sever the center fibers at joint end 38. Rarefying of first tow 20 and second tow 30 may occur sequentially or simultaneously.

To bring rarefied second tow 30 down into position over rarefied first tow 20, U-shaped first and second tow pullers 98 and 96, respectively, are lowered from a retreated position to a first position that is vertically aligned with the first tow 20 which is supported by first tow holder 60 and second tow holder 64. Tow pullers 96 and 98 may be moved by an actuator. In one embodiment, the tow pullers are moveable by the action of a pneumatic cylinder.

Figure 8:
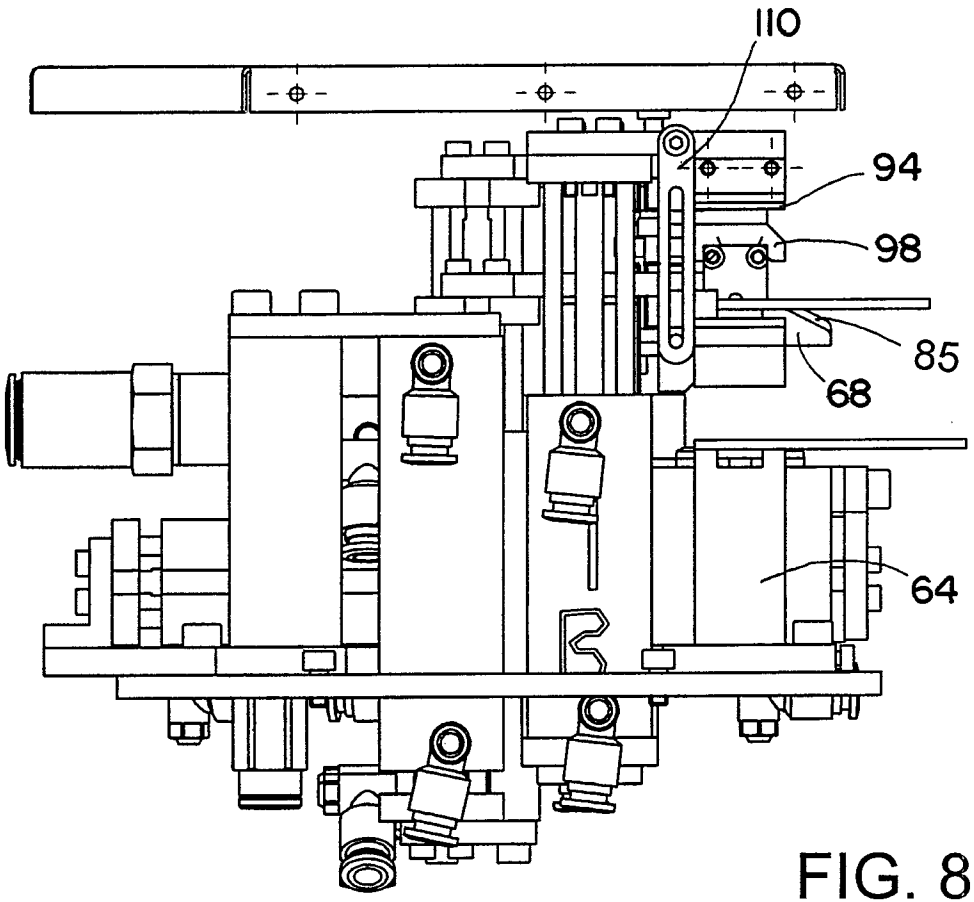
FIG. 8 is a side view of the splicing apparatus shown in FIG. 3.
Figure 9:
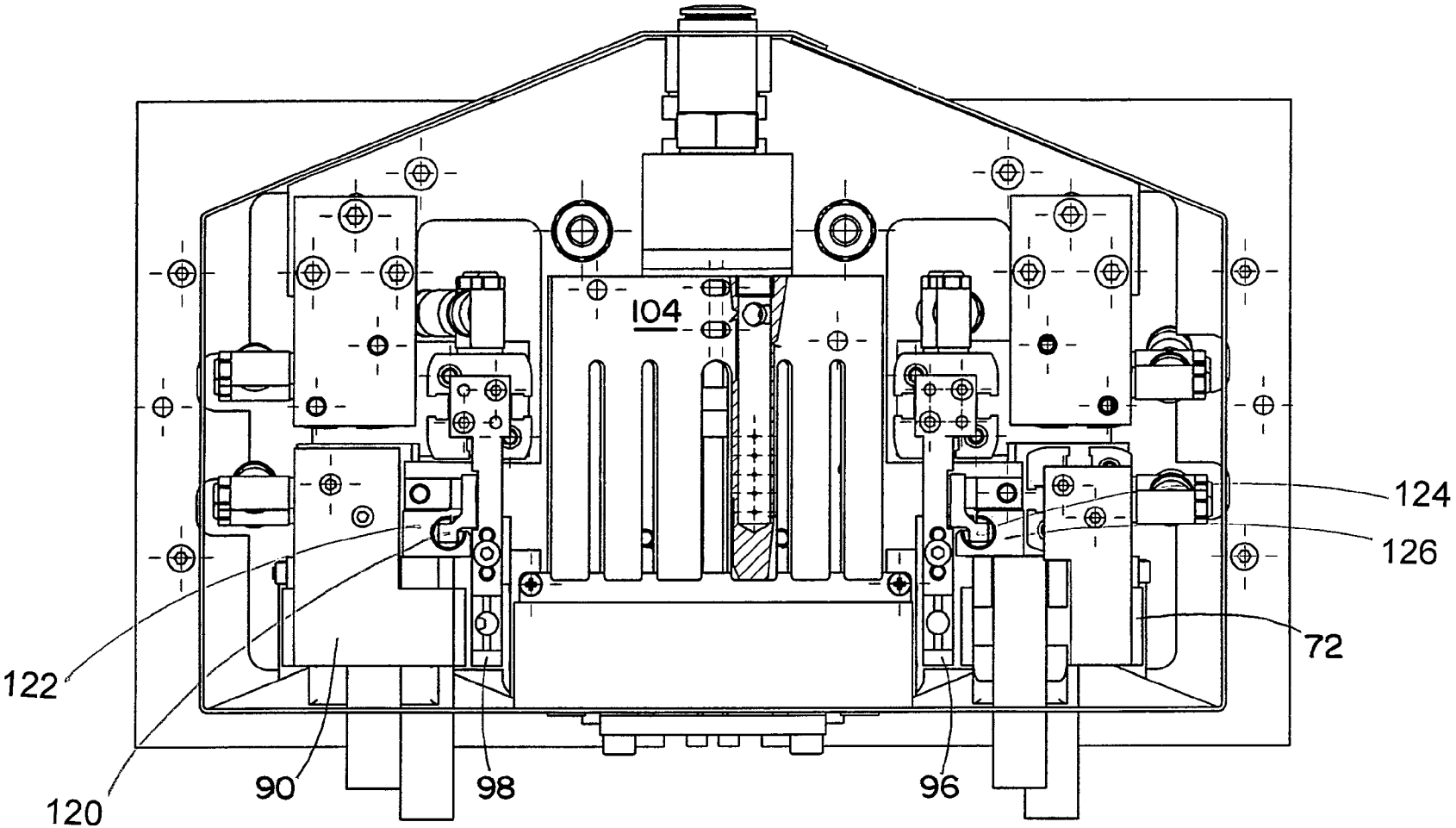
FIG. 9 is a top view of the splicing apparatus shown in FIG. 3.

Referring to FIGS. 8 and 9, upper blowing head 104 and lower blowing head 106 are moved forward (perpendicular to the lengthwise direction of the fiber tows) via a first slider 108 and a second slider (shown in FIG. 3), so that the first and second tows 20 and 30 are positioned between the upper blowing head 104 and the lower blowing head 106. Upper and lower blowing heads 104 and 106 may be moved by an actuator. In one embodiment, the blowing heads are moveable by the action of a pneumatic cylinder.

To position rarefied second tow 30 so that the rarefied portion 36 is between the upper and lower blowing heads 104 and 106, second tow puller 96 is lowered to a second position that is proximate to baseplate 52, so that it contacts the second tow 30 and pulls it to the right. To position rarefied first tow 20 so that the rarefied portion 26 is in overlapped alignment with the rarefied portion 36 of second tow 30 between the upper and lower blowing heads 104 and 106, first tow puller 98 is lowered to a second position that is proximate to baseplate 52, so that it contacts first tow 20 and pulls it to the left. Vertical movement of first tow puller 98 is guided by the movement of first linear bearing 120 within first rail 122. Vertical movement of second tow puller 96 is guided by the movement of second linear bearing 124 within second rail 126.

Figure 10B:
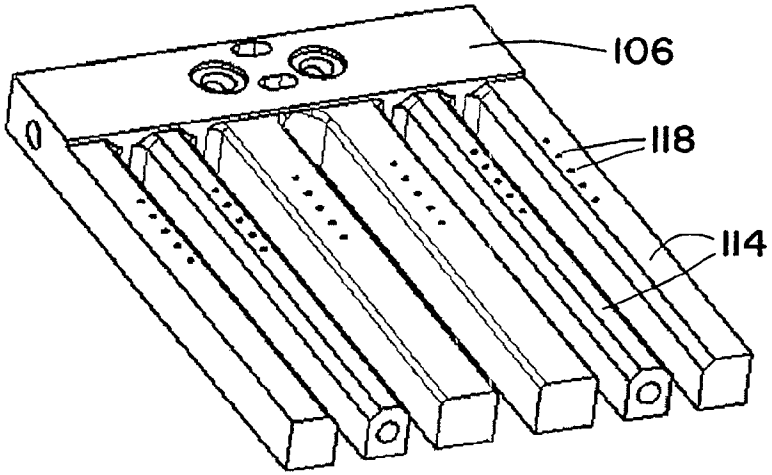
FIGS. 10A and 10B are schematic perspective views of the upper and lower blowing heads, respectively, of the splicing apparatus shown in FIG. 3.
Figure 10A:
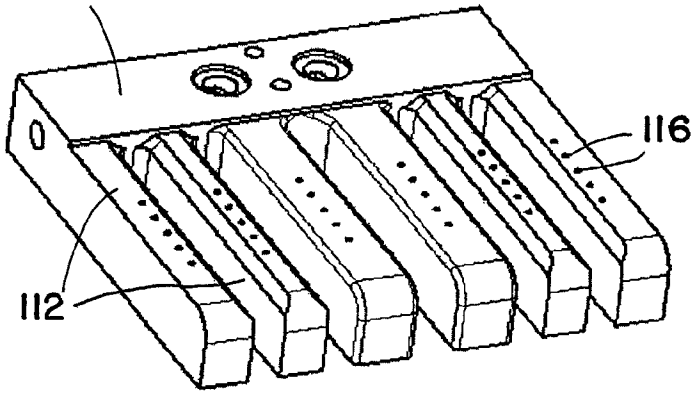
Figure 10C:
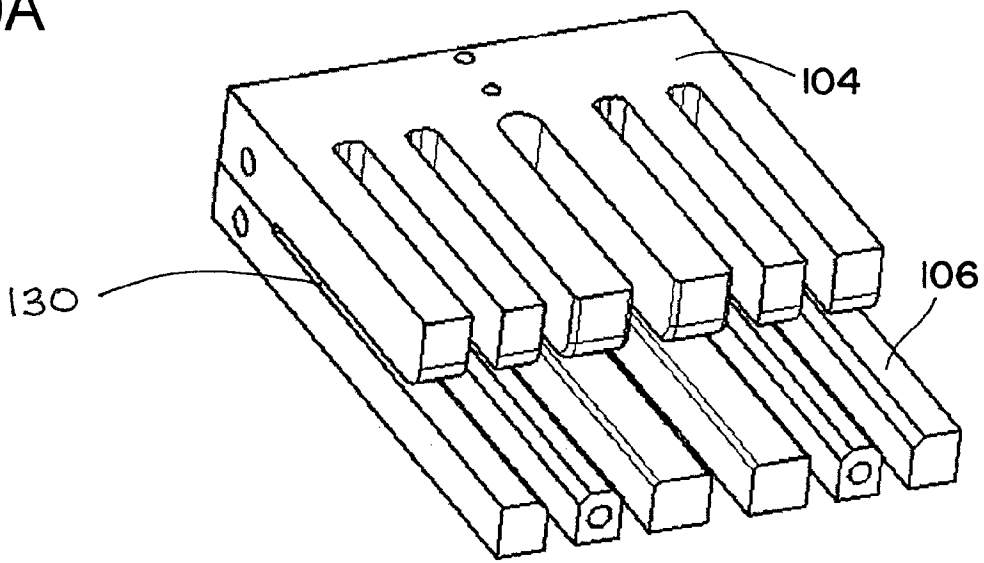
FIG. 10C is a schematic perspective view showing the upper and lower blowing heads of FIGS. 10A and 10B positioned for the joining operation.

With the rarefied portions 26 and 36 of first and second tows 20 and 30, respectively, aligned between the upper blowing head 104 and the lower blowing head 106, the fibers of the tows can be entangled to form the splice 42. Referring to FIGS. 10A-10C, upper blowing head 104 includes multiple arms 112, each arm having a plurality of gas nozzles 116. Lower blowing head 106 includes multiple arms 114, each arm having a plurality of gas nozzles 118. Upper blowing head 104 is positioned over lower blowing head 106, creating a passage 130 between the upper and lower blowing heads. The gas nozzles 116 of the upper blowing head face the gas nozzles 118 of the lower blowing head 106. High pressure gas injected from the gas nozzles 116 and 118 is directed at the fibers of overlapped rarefied portions 26 and 36 positioned within passage 130. The turbulent gas flow causes the fibers to become entangled, forming splice 42.

The splicing apparatus may be provided with a controller (not shown) operatively coupled to the actuator for automatically controlling the operating sequence of the individual components and procedures.

EXAMPLE

Two lengths of Panex® 35 carbon fiber tow, having 50,000 fibers each were spliced by rarefying an end of each tow, overlapping the rarefied ends and subjecting the rarefied portion to air entanglement. The tensile strength of the Panex® 35 carbon fiber tow used was about 4137 Mpa, the tensile modulus was about 242 GPa, and the density was about 1.81 g/cc. The fiber diameter of the fibers of the tow was about 7.2 microns. FIG. 9 is a photograph of the carbon fiber tow splice of two joined lengths of Panex® 35 carbon fiber tow. The density of the spliced carbon fiber tow is substantially uniform along the length of the tow.

The strength of the splice of the resulting spliced carbon fiber tow as tested by measuring the force required to split the splice. Table 1 below lists the splice strength for a number of tested splices. FIG. 10 is a histogram of the splice strength (in Newtons) vs. the frequency for the tested splices.

TABLE 1

| Standard PX-35, 2x25K splice split | | | |
|---|---|---|---|
| | N | lbs | kg |
| 1 | 540.5 | 121.5 | 55.1 |
| 2 | 800.9 | 180.1 | 81.7 |
| 3 | 523.7 | 117.7 | 53.4 |

TABLE 1-continued

| Standard PX-35, 2x25K splice split | | | |
|---|---|---|---|
| | N | lbs | kg |
| 4 | 665.5 | 149.6 | 67.9 |
| 5 | 662.5 | 148.9 | 67.6 |
| 6 | 625.4 | 140.6 | 63.8 |
| 7 | 573.3 | 128.9 | 58.5 |
| 8 | 777.2 | 174.7 | 79.3 |
| 9 | 536.9 | 120.7 | 54.7 |
| 10 | 548.3 | 123.3 | 55.9 |
| 11 | 877.8 | 197.3 | 89.5 |
| 12 | 539.1 | 121.2 | 55.0 |
| 13 | 658.4 | 148.0 | 67.1 |
| 14 | 915.0 | 205.7 | 93.3 |
| 15 | 798.5 | 179.5 | 81.4 |
| 16 | 710.5 | 159.7 | 72.5 |
| 17 | 562.4 | 126.4 | 57.3 |
| 18 | 779.8 | 175.3 | 79.5 |
| 19 | 613.6 | 137.9 | 62.6 |
| 20 | 663.1 | 149.1 | 67.6 |
| 21 | 527.5 | 118.6 | 53.8 |
| 22 | 431.4 | 97.0 | 44.0 |
| 23 | 676.9 | 152.2 | 69.0 |
| 24 | 686.3 | 154.3 | 70.0 |
| 25 | 700.9 | 157.6 | 71.5 |
| 26 | 536.9 | 120.7 | 54.7 |
| 27 | 658.6 | 148.0 | 67.2 |
| 28 | 583.4 | 131.1 | 59.5 |
| 29 | 693.7 | 155.9 | 70.7 |
| 30 | 464.5 | 104.4 | 47.4 |
| 31 | 451.2 | 101.4 | 46.0 |
| 32 | 426.2 | 95.8 | 43.5 |
| Min | 426.2 | 95.8 | 43.5 |
| Max | 915.0 | 205.7 | 93.3 |
| Avg | 631.6 | 142.0 | 64.4 |

Figure 11:
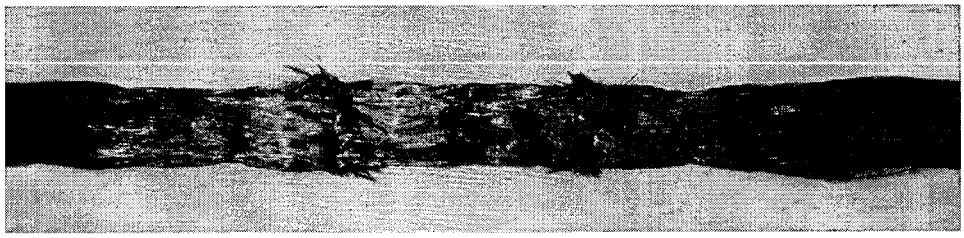
FIG. 11 is a photograph of a carbon fiber tow splice in accordance with the present invention.

The strength of the splice was also tested by submerging the spliced carbon fiber tow in epoxy resin and then measuring the force required to split the splice wetted by the epoxy resin. Table 2 below lists the splice strength for a number of tested splices. FIG. 11 is a histogram of the splice strength (in Newtons) vs. the frequency for the tested splices.

TABLE 2

| Standard PX-35, 2x25K splice split strength, impregnated | | | |
|---|---|---|---|
| | N | lbs | kg |
| 1 | 701.3 | 157.7 | 71.5 |
| 2 | 468.3 | 105.3 | 47.7 |
| 3 | 612.6 | 137.7 | 62.5 |
| 4 | 453.1 | 101.8 | 46.2 |
| 5 | 320.1 | 72.0 | 32.6 |
| 6 | 480.2 | 107.9 | 49.0 |
| 7 | 350.2 | 78.7 | 35.7 |
| 8 | 774.6 | 174.1 | 79.0 |
| 9 | 563.4 | 126.7 | 57.5 |
| 10 | 278.1 | 62.5 | 28.4 |
| 11 | 444.1 | 99.8 | 45.3 |
| 12 | 511.8 | 115.1 | 52.2 |
| 13 | 348.4 | 78.3 | 35.5 |
| 14 | 655.1 | 147.3 | 66.8 |
| Min | 278.1 | 62.5 | 28.4 |
| Max | 774.6 | 174.1 | 79.0 |
| Avg | 497.2 | 111.8 | 50.7 |
| Dev | 149.5 | 33.6 | 15.2 |

The dry splice joint, in one embodiment, is able to withstand a tension force of at least 40 kg, or at least 60 kg. The splice joint, in one embodiment, when impregnated with uncured epoxy resin, is able to withstand a tension force of at least 28 kg, or at least 50 kg.

Figure 12:
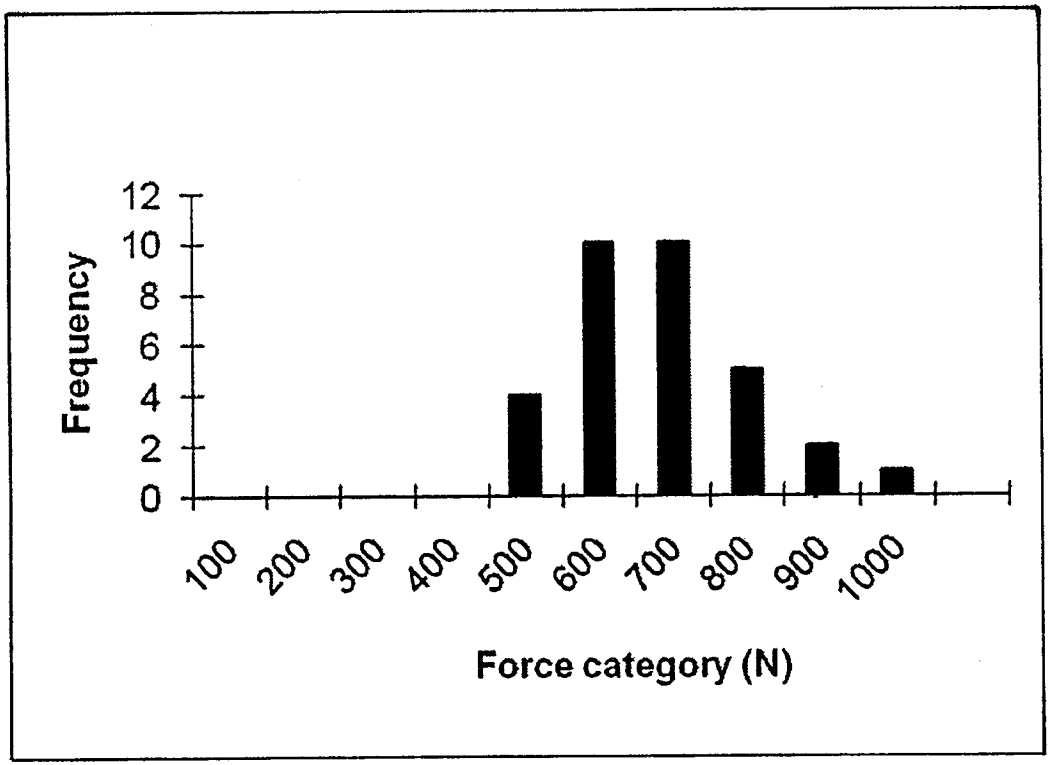
FIG. 12 is a histogram showing the splice strength of a dry, spliced carbon tow according to the present invention.
Figure 13:
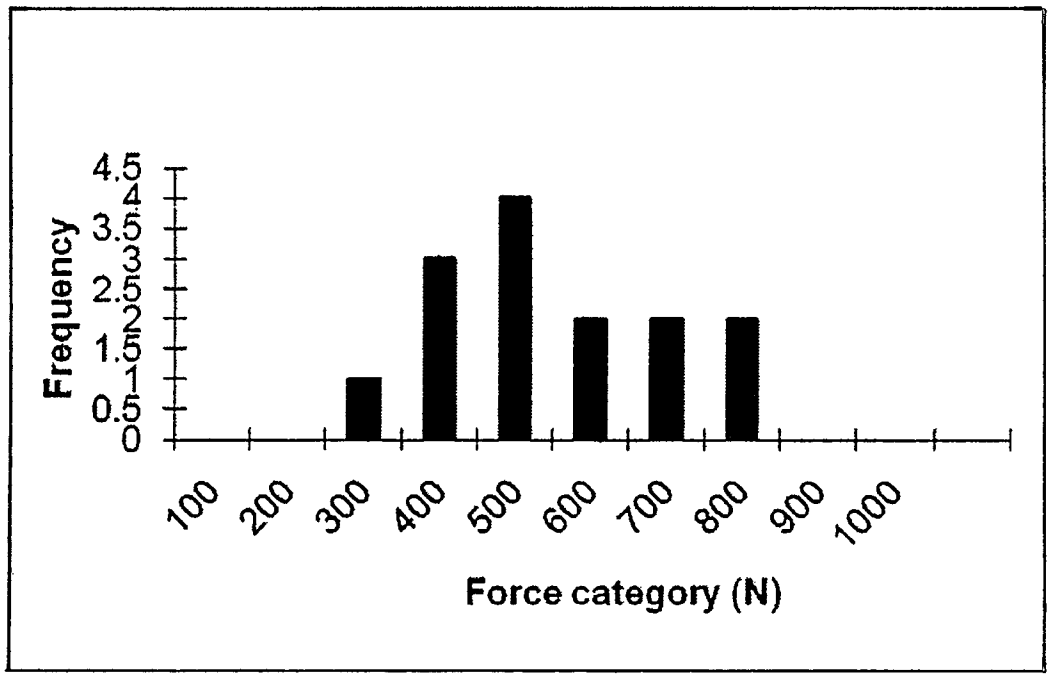
FIG. 13 is a histogram showing the splice strength of a spliced carbon tow according to the present invention after being impregnated with uncured epoxy resin.
Figure 14:
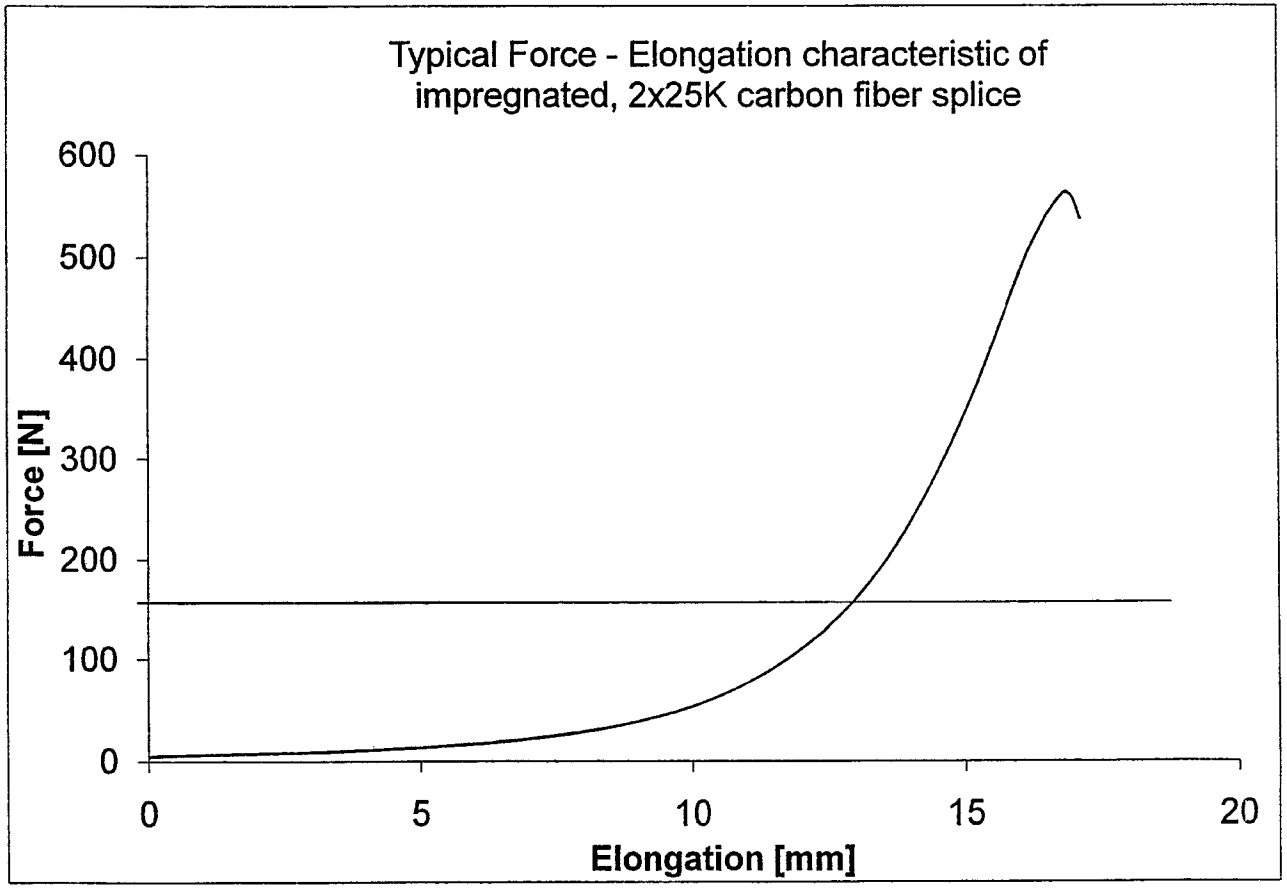
FIG. 14 is a graph of the force vs. elongation characteristic of an impregnated spliced carbon tow according to the present invention.

FIG. 12 is a graph of the force vs. elongation characteristic of an impregnated spliced carbon tow produced by the method described herein.

While the invention has been explained in relation to various embodiments, it is to be understood that various modifications thereof will be apparent to those skilled in the art upon reading the specification. The features of the various embodiments of the articles described herein may be combined within an article. Therefore, it is to be understood that the invention described herein is intended to cover such modifications as fall within the scope of the appended claims.

What is claimed is:

1. A method for forming a spliced carbon fiber tow, comprising:

providing a first carbon fiber tow having a terminal end and a starting end, and a second carbon fiber tow having a terminal end and a starting end, the first and second carbon fiber tows each containing 3,000 or more carbon fiber filaments;

cutting and removing a portion of the fiber filaments of the first carbon fiber tow to form a rarefied region that extends from the terminal end of the first carbon fiber tow to a first joint end;

cutting and removing a portion of the fiber filaments of the second carbon fiber tow to form a rarefied region that extends from the starting end of the second carbon fiber tow to a second end joint;

aligning the rarefied region of the first carbon fiber tow with the rarefied region of the second carbon fiber tow so that so that the starting end of the second carbon fiber tow substantially meets the joint end of the first carbon fiber tow, and the terminal end of the first carbon fiber tow substantially meets joint end of the second carbon fiber tow; and subjecting the aligned rarefied regions of the first carbon fiber tow and the second carbon fiber tow to gas turbulences to effect entanglement of the carbon fiber filaments of the first and second carbon fiber tows with each other so as to form a splice, wherein the density of the spliced carbon fiber tow is substantially uniform from the starting end of the first carbon fiber tow to the terminal end of the second carbon fiber tow.

2. The method of claim 1 wherein the first and second carbon fiber tows each contain 50,000 or more carbon fiber filaments.

3. The method of claim 1 wherein cutting the first carbon fiber tow and cutting the second carbon fiber tow are carried out simultaneously.

* * * * *